US009555653B2

(12) United States Patent
Kanno

(10) Patent No.: US 9,555,653 B2
(45) Date of Patent: Jan. 31, 2017

(54) INSPECTION APPARATUS AND METHOD FOR LIQUID DISCHARGE HEAD AND LIQUID DISCHARGE HEAD

(71) Applicant: CANON KABUSHIKI KAISHA, Tokyo (JP)

(72) Inventor: Hideo Kanno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/049,787

(22) Filed: Feb. 22, 2016

(65) Prior Publication Data

US 2016/0257151 A1 Sep. 8, 2016

(30) Foreign Application Priority Data

Mar. 3, 2015 (JP) ..... 2015-041138

(51) Int. Cl.
*B41J 29/393* (2006.01)

(52) U.S. Cl.
CPC ..... *B41J 29/393* (2013.01)

(58) Field of Classification Search
None
See application file for complete search history.

(56) References Cited

U.S. PATENT DOCUMENTS 7,722,148 B2 5/2010 Takabayashi et al.
8,287,082 B2 10/2012 Aoki et al.
8,833,889 B2 9/2014 Kanno et al.
2001/0038396 A1* 11/2001 Imanaka ..... B41J 2/0451 347/7
2010/0079535 A1* 4/2010 Sayama ..... B41J 2/04561 347/19

FOREIGN PATENT DOCUMENTS

JP 02-208052 A 8/1990
JP 10-217471 A 8/1998

* cited by examiner

*Primary Examiner* — Matthew Luu
*Assistant Examiner* — Tracey McMillion
(74) *Attorney, Agent, or Firm* — Fitzpatrick, Cella, Harper & Scinto

(57) ABSTRACT

An apparatus for inspecting a liquid discharge head including an energy generation element provided on an element substrate and configured to make energy act on a liquid to discharge the liquid from an orifice, a lower protection film having an electrical insulating property and provided on the element substrate while covering the energy generation element, a wiring layer provided between the element substrate and the lower protection film and configured to supply electrical signal for driving to the energy generation element, and a conductive upper protection film provided on the lower protection film is provided. The apparatus comprises a detection circuit configured to detect a potential of the upper protection film when the energy generation element is driven; and a determination circuit configured to determine a driving state of the energy generation element from information about the potential detected by the detection circuit.

14 Claims, 10 Drawing Sheets

INSPECTION APPARATUS AND METHOD FOR LIQUID DISCHARGE HEAD AND LIQUID DISCHARGE HEAD

BACKGROUND OF THE INVENTION

Field of the Invention

The present invention relates to a liquid discharge head that discharges a liquid from an orifice by making energy act on the liquid. In particular, the present invention relates to an inspection apparatus and method for inspecting the quality of driving of an energy generation element that is provided on the liquid discharge head and generates energy to discharge the liquid, and a liquid discharge head suitable for the inspection method.

Description of the Related Art

A liquid discharge head makes energy act on a liquid existing in a fluid channel and thus discharges the liquid from an orifice. To make energy act on the liquid in the fluid channel, an energy generation element is often provided in the vicinity of the fluid channel. The energy generation element is generally formed on one surface of a substrate made of, for example, silicon. The energy generation element is in contact with the liquid via a protection film formed on its surface, and is driven by a pulse-like electrical signal. The substrate on which the energy generation element is provided is called an element substrate. In a liquid discharge head of a type that applies thermal energy to a liquid to partially vaporize and expand the liquid and thus discharges the liquid from the orifice as a droplet, for example, a resistive heating element is used as the energy generation element. In a liquid discharge head of a type that makes mechanical energy directly act on a liquid, for example, a piezoelectric element is used as the energy generation element.

A representative example of the liquid discharge head is an inkjet print head that discharges an ink droplet to print. When the liquid discharge head is an inkjet print head, the energy generation element is particularly called a print element. In the inkjet print head, to achieve printing of higher image quality at a higher speed, print elements and orifices are arranged at a higher density, and a number of orifices are arrayed. Accordingly, the occurrence probability of a fault such as a rupture of a print element itself or disconnection of an electric wire provided on the element substrate and connected to a print element rises. Hence, inspection in the manufacturing process is one of important steps. Even during actual use after shipment, the occurrence frequency of a malfunction such as a rupture of a print element or disconnection of a wire rises as the use time accumulates. Hence, the inkjet print head is demanded to be inspectable even in an actual use environment.

Considering the above problems, print inspection by actually discharging ink is widely carried out for the inkjet print head in the manufacturing process or in an environment where the inkjet print head is actually used. In print inspection, the inkjet print head is driven to print a specific image pattern on a print medium such as a paper sheet surface. The print pattern formed on the print medium is visually recognized or read by an optical sensor and inspected.

Japanese Patent Laid-Open No. 2-208052 discloses, in a liquid discharge head using a resistive heating element, providing a detection circuit configured to detect the value of a current flowing to the resistive heating element on a wire that supplies power to the resistive heating element and detecting a rupture of the resistive heating element based on the current value detected by the detection circuit.

Japanese Patent Laid-Open No. 10-217471 discloses, as a method of inspecting an inkjet print head that uses conductive ink, a method of doing inspection by monitoring a voltage waveform applied to a print element by an electrode in an ink tank. In the method of Japanese Patent Laid-Open No. 10-217471, using a protection film provided on the surface of the print element as a capacitor, the voltage waveform is monitored via the capacitor and the ink that is a conducting path, and clogging in an ink channel, a rupture of a print element, or disconnection of an electric wire is inspected based on the obtained voltage waveform.

Out of the above-described inspection methods, print inspection in the inkjet print head can inspect whether discharge is normal or not but cannot determine whether the cause of a discharge error is an electrical failure such as a rupture of a print element or disconnection of a wire, or a fault in an orifice or an ink channel. For this reason, if deterioration of print quality has occurred during use, a recovery operation such as ink suction is performed regardless of the cause. If the cause is an electrical failure, ink and time are wasted.

According to the method of Japanese Patent Laid-Open No. 2-208052, it is possible to inspect an electrical failure in the inkjet print head. A detailed arrangement of the detection circuit is not mentioned in Japanese Patent Laid-Open No. 2-208052. As a general and simple arrangement, a current sensing resistor is inserted midway through a power supply line, and a voltage drop that occurs in accordance with a current value is measured by a voltmeter and inspected. In the inkjet print head, however, a smoothing capacitor is inserted in the power supply line to a print element. When performing inspection, the smoothing capacitor needs to be detached to detect an accurate current.

Inspection using the method of Japanese Patent Laid-Open No. 2-208052 is inspection performed under an operation condition including the voltage drop. In a strict sense, an actual operation is not reproduced in the inspection.

In the method of Japanese Patent Laid-Open No. 10-217471, both a discharge error caused by an electrical failure and a discharge error caused by a fault in an ink channel can be inspected using ink as a conductor. However, since the ON resistance of the ink variously changes in accordance with the amount or distribution of bubbles generated in the ink channel, quality determination may be difficult depending on the obtained voltage waveform. Since the electrode for detection needs to be provided in the ink tank, the cost of the ink tank becomes high. In addition, the method of Japanese Patent Laid-Open No. 10-217471 assumes use of conductive ink and is therefore hardly applicable to a general liquid discharge head that does not necessarily discharge a conductive liquid.

SUMMARY OF THE INVENTION

One aspect of the present invention provides an inspection apparatus and method for a liquid discharge head which can inspect the quality of an energy generation element or a wire connected to it by a simple arrangement.

Another aspect of the present invention provides a liquid discharge head which can inspect the quality of an energy generation element or a wire connected to it by a simple arrangement.

According to one aspect of the present disclosure, an inspection apparatus for inspecting a liquid discharge head including an energy generation element provided on an element substrate and configured to make energy act on a liquid to discharge the liquid from an orifice, a lower protection film having an electrical insulating property and provided on the element substrate while covering the energy generation element, a wiring layer provided between the element substrate and the lower protection film and configured to supply an electrical signal for driving to the energy generation element, and a conductive upper protection film provided on the lower protection film is provided. The inspection apparatus comprises a detection circuit configured to detect a potential of the upper protection film when the energy generation element is driven; and a determination circuit configured to determine a driving state of the energy generation element from information about the potential detected by the detection circuit.

According to an exemplary embodiment of the present invention, the inspection apparatus is connected to the liquid discharge head via a wire and detects the potential change of the upper protection film. It is therefore possible to inspect the liquid discharge head by a simple arrangement without providing a dedicated detection member or detection electrode separately from the liquid discharge head.

Further features of the present invention will become apparent from the following description of exemplary embodiments (with reference to the attached drawings).

DESCRIPTION OF THE EMBODIMENTS

Preferred embodiments of the present invention will now be described with reference to the accompanying drawings.

Figure 1A:
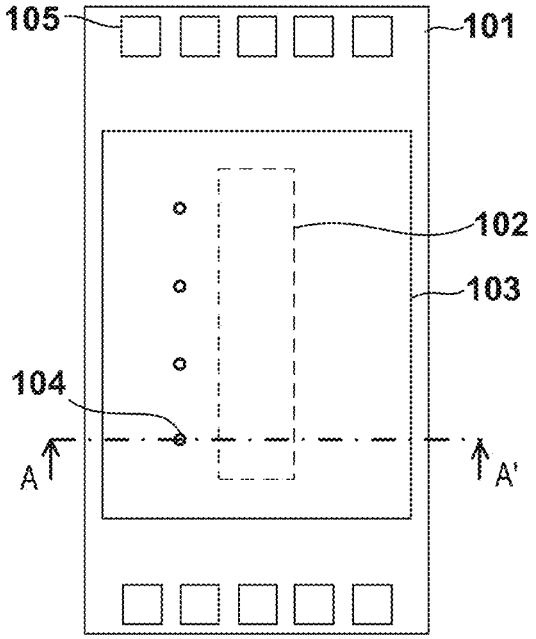
FIGS. 1A and 1B are views showing a liquid discharge head according to the first embodiment of the present invention.
Figure 1B:
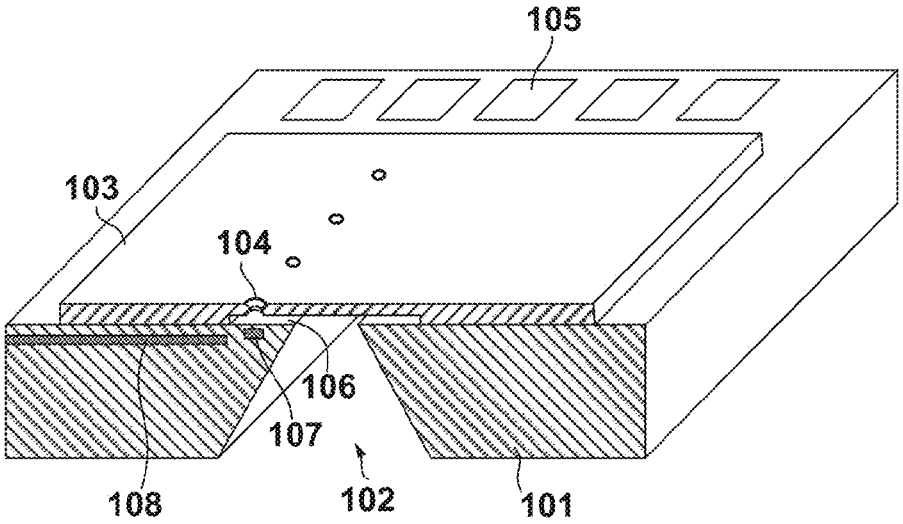

FIGS. 1A and 1B are views for explaining a liquid discharge head according to the first embodiment of the present invention. FIG. 1A is a plan view, and FIG. 1B is a sectional view taken along a line A-A' in FIG. 1A. A description will be made here assuming that the liquid discharge head is an inkjet print head that discharges ink as a liquid. Hence, an energy generation element will be referred to as a print element hereinafter. The liquid discharge head to which the present invention is applied is not limited to the inkjet print head.

An orifice forming member 103 is arranged on one surface (the upper surface shown in FIGS. 1A and 1B) of an element substrate 101 made of silicon or the like. Orifices 104 to discharge a liquid are arrayed at a predetermined interval in the orifice forming member 103. Here, four orifices 104 are arranged in a line at a predetermined interval. A print element 107 is provided on one surface of the element substrate 101 in correspondence with the position of each orifice 104. A supply channel 102 to which a liquid, for example, ink is supplied is provided so as to penetrate through the element substrate 101. The orifice forming member 103 is provided with a fluid channel 106 for each orifice 104 such that the liquid supplied to the supply channel 102 reaches the position of the print element 107. The orifice 104 communicates with the fluid channel 106. A driving circuit 108 configured to drive the print element 107 is also formed on the element substrate 101. Electrode terminals 105 for electrical connection between external wires and circuits such as the driving circuit 108 are also provided at one end of one surface of the element substrate 101.

Figure 2A:
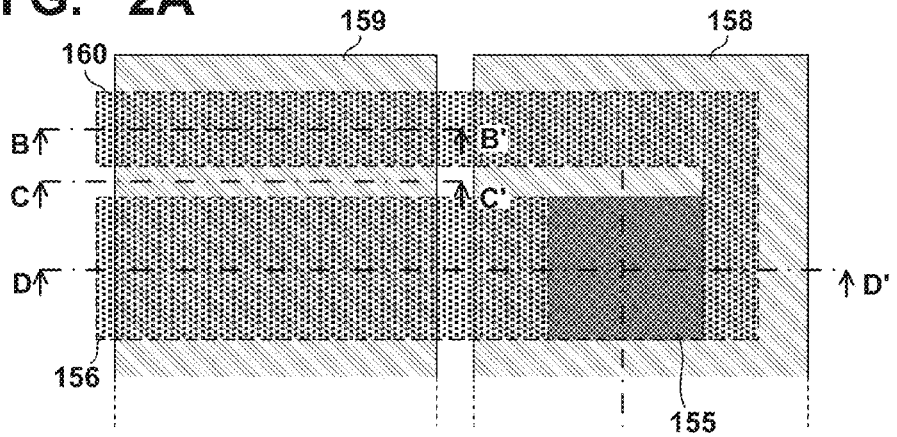
FIGS. 2A, 2B, 2C, and 2D are views showing the structure of an element substrate in the liquid discharge head shown in FIGS. 1A and 1B.
Figure 2B:
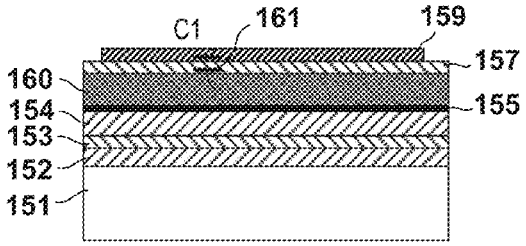
Figure 2C:
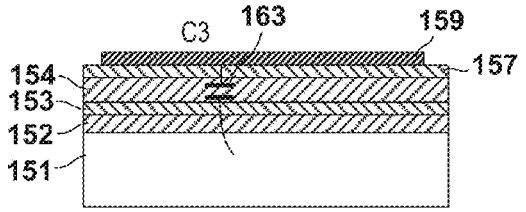
Figure 2D:
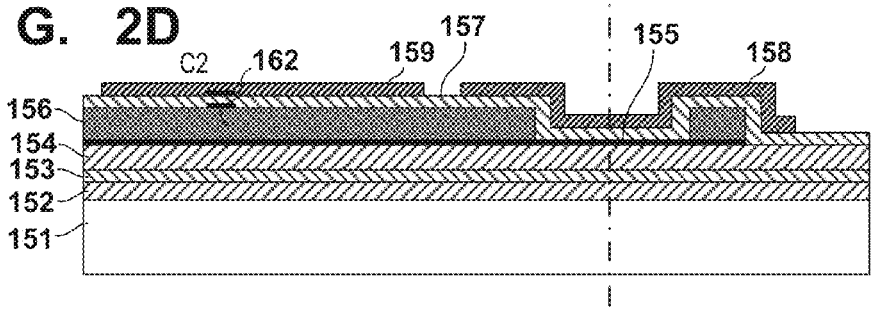

FIGS. 2A, 2B, 2C, and 2D illustrate details of the element substrate 101 in the liquid discharge head. FIG. 2A is a plan view, FIG. 2B is a sectional view taken along a line B-B', FIG. 2C is a sectional view taken along a line C-C', and FIG. 2D is a sectional view taken along a line D-D'. The element substrate 101 mainly uses a silicon substrate 151. A field oxidization film 152 made of $SiO_2$ or the like is formed on one entire surface of the silicon substrate 151. Insulation films 153 and 154 are sequentially stacked on the field oxidization film 152. A U-shaped resistive heating layer 155 made of TaSiN or the like is provided on the insulation film 154. A wiring layer made of Al or the like and having the same U shape as the resistive heating layer 155 is provided to be thicker than the resistive heating layer 155. However, the wiring layer is broken near the bending portion at a distal end of the U shape. In the broken portion, the resistive heating layer 155 is not covered with the wiring layer. The wiring layer is divided into an individual wire 156 and a common wire 160 by the broken portion. Both the individual wire 156 and the common wire 160 are electrically connected to the driving circuit 108. When a voltage is applied between the individual wire 156 and the common wire 160 to supply a current, the current flows only to the resistive heating layer 155 in the broken portion of the wiring layer. For this reason, heat concentrates to this portion. Hence, this portion constitutes the print element 107 as an energy generation element. The print element 107 serving as an energy generation element makes energy that is thermal energy act on the liquid. The individual wire 156 and the common wire 160 as the wiring layer function as wires that electrically connect the print element 107 to the driving circuit 108 in the element substrate 101, and supply an electrical signal for driving to the print element 107.

Additionally, in the element substrate 101, a lower protection film 157 made of SiN or the like is stacked on the entire surface of the insulation film 154 including the portion covered with the resistive heating layer 155, the individual wire 156, and the common wire 160. The lower protection film 157 needs to have an electrical insulating property. An upper protection film made of, for example, Ta is further formed on the lower protection film 157. The upper protection film includes a first portion provided in correspondence with a position where the print element 107 is formed and a second portion provided not on the position where the print element 107 is formed but to cover the individual wire 156 and the common wire 160. The first portion has a function of protecting the print element 107 from cavitation that occurs when the print element 107 that is a resistive heating element or electrothermal transducer is driven, and bubbles are generated in the liquid in the liquid discharge head. Hence, the first portion will be referred to as an anti-cavitation film 158. The anti-cavitation film 158 is provided between the liquid and the lower protection film 157. On the other hand, the second portion has not only a function as a protection film but also a function of detecting a change in the potential of the individual wire 156 and the common wire 160 as it is formed in correspondence with a position where the individual wire 156 and the common wire 160 are formed. Hence, the second portion will be referred to as a detection electrode 159. As will be described later, to detect the potential in the detection electrode 159 and determine a malfunction, the detection electrode 159 is connected to a terminal 211 (see FIGS. 3A, 3B, and 3C). For the descriptive convenience, the individual wire 156, the common wire 160, and the resistive heating layer 155 of the portion covered with the anti-cavitation film 158 and the detection electrode 159 serving as the upper protection film are illustrated in FIG. 2A, but the lower protection film 157 is not illustrated.

FIGS. 2A, 2B, 2C, and 2D illustrate only a portion corresponding to one print element 107 for the descriptive convenience. However, a plurality of print elements 107 are provided on the element substrate 101, as described with reference to FIGS. 1A and 1B. When the plurality of print elements 107 are arranged in a line on the element substrate 101, the anti-cavitation film 158 can be provided commonly for the plurality of print elements 107 so as to extend over the print elements 107. In the first embodiment, the detection electrode 159 is also provided commonly for the individual wire 156 and the common wire 160 connected to each of the plurality of print elements 107 so as to cover the individual wire 156 and the common wire 160. In FIGS. 2A to 2D, the upper protection film is separated into the anti-cavitation film 158 that is the first portion and the detection electrode 159 that is the second portion, which are electrically insulated from each other. However, the anti-cavitation film 158 and the detection electrode 159 may integrally be formed on the lower protection film 157 without being separated.

A parasitic capacitance formed in association with the detection electrode 159 will be described here. As shown in FIG. 2B, the detection electrode 159 forms a capacitance (capacitor) 161 with respect to the common wire 160 via the lower protection film 157. The capacitance value of the capacitance is defined as C1. As shown in FIG. 2D, the detection electrode 159 forms a capacitance 162 with respect to the individual wire 156 via the lower protection film 157. The capacitance value of the capacitance is defined as C2. At a position where the individual wire 156 and the common wire 160 are not formed, as shown in FIG. 2C, the detection electrode 159 forms a capacitance 163 with respect to the silicon substrate 151 via the field oxidization film 152, the insulation films 153 and 154, and the lower protection film 157. The capacitance value of the capacitance is defined as C3. The silicon substrate 151 is generally fixed to the ground potential (GND).

Figure 3A:
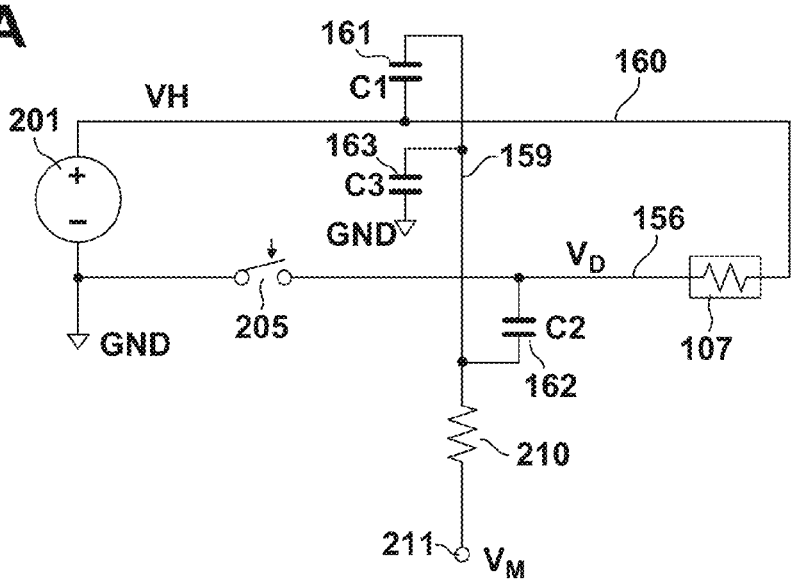
FIG. 3A is an equivalent circuit diagram including a print element, a driving circuit, and a protection film according to the first embodiment.

FIG. 3A shows an electrical equivalent circuit of the liquid discharge head including the print element 107, the driving circuit 108, and the detection electrode 159. Each print element 107 is connected to one output terminal (in FIG. 3A, a (+) terminal) of a DC power supply 201 via the common wire 160, and also connected to the other output terminal of the DC power supply 201 via the individual wire 156 and a drive switch 205. The other output terminal of the DC power supply 201 is connected to the ground potential as well. The output voltage of the DC power supply 201 is defined as a power supply voltage VH, and the potential of the individual wire 156 is defined as $V_D$. When the plurality of print elements 107 is provided, the common wire 160 serves as a wire used to commonly connect the print elements 107 to the DC power supply 201, and the individual wire 156 serves as a wire used to individually drive the print elements 107. The drive switch 205 is provided in the driving circuit 108 as a switching element. FIG. 3A also illustrates the above-described three capacitances 161 to 163 associated with the detection electrode 159. The detection electrode 159 is connected to the terminal 211 via a wiring resistance 210. For example, any one of a plurality of electrode terminals 105 provided on the element substrate 101 is used as the terminal 211. The detection electrode 159 and the terminal 211 are electrically connected by a wiring layer provided on the element substrate 101.

Figure 3B:
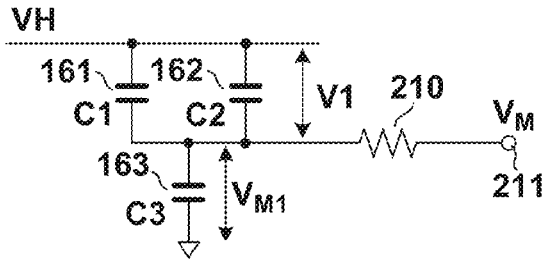
FIG. 3B is an equivalent circuit diagram for explaining a detected potential in an initial state.
Figure 3C:
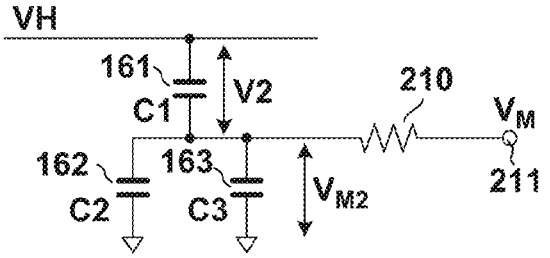
FIG. 3C is an equivalent circuit diagram for explaining a detected potential when a drive switch is set in an ON state.

A change in the potential of the detection electrode 159 will be described using the equivalent circuits shown in FIGS. 3A, 3B, and 3C. In the initial state, that is, when the drive switch 205 is in an OFF state, the potential $V_D$ of the individual wire 156 is set to the power supply voltage VH via the print element 107. Since the capacitance C1 is also connected to the power supply voltage VH, the voltage across the capacitance 161 and that across the capacitance 162 equal each other at this time, as shown in FIG. 3B. This voltage is defined as V1. A potential $V_M$ of the terminal 211 of the detection electrode 159 at this time is represented by $V_{M1}$. $V_{M1}$ equals the voltage across the capacitance 163, and $$V1:\ V_{M1} = \frac{1}{C1 + C2} : \frac{1}{C3} \tag{1}$$

holds. As described above, the capacitance values of the capacitances 161 to 163 are C1 to C3, respectively.

In a state in which the drive switch 205 is set in an ON state, and a current flows to the print element 107, the potential $V_D$ of the individual wire 156 is set to the ground potential GND via the drive switch 205. Hence, as shown in FIG. 3C, the terminals of the capacitance 162 are connected to the detection electrode 159 and the ground potential GND, respectively. The voltage across the capacitance 162 and that across the capacitance 163 equal each other. The voltage across the capacitance 161 at this time is represented by V2, and the potential $V_M$ of the terminal 211 is represented by $V_{M2}$. $V_{M2}$ equals the voltage across the capacitance 163, and $$V2:\ V_{M2} = \frac{1}{C1} : \frac{1}{C2 + C3} \tag{2}$$

holds.

A potential change amount $\Delta V_M$ generated in the detection electrode 159 by turning on/off the drive switch 205 is given by $$\Delta V_M = V_{M1} - V_{M2} \quad (3)$$

As is apparent from equation (3), the potential change $\Delta V_M$ occurs from the relationship of the divided voltages of the capacitances represented by equations (1) and (2). Note that if the power supply voltage VH is constant, $$V1 + V_{M1} = V2 + V_{M2} = VH \quad (4)$$

holds. Hence, according to equations (1) to (4), we obtain $$\Delta V_M = \frac{C2}{C1 + C2 + C3} \cdot VH \quad (5)$$

To obtain the potential change $\Delta V_M$, it is necessary to prohibit the potential of the detection electrode 159 from being fixed, as a matter of course. As a circuit for measuring the potential $V_M$ of the detection electrode, a circuit having a high input impedance and a small input capacitance needs to be used. As can be seen from equation (5), $\Delta V_M$ can effectively be increased by increasing the capacitance value C2 to the individual wire 156. For example, the potential change $\Delta V_M$ is evaluated from experimental values estimated for the liquid discharge head according to this embodiment. For example, when C1=0.38 pF, C2=0.001 pF, C3=0.033 pF, and the voltage VH of the DC power supply 201=18 V, the detected potential $V_{M1}$ in the initial state is 16.595 V. According to equation (2), the detected potential $V_{M2}$ in a state in which the drive switch 205 is driven and set in the ON state is 16.521 V. The potential change $\Delta V_M$ ($=V_{M1}-V_{M2}$) is thus estimated as 0.0434 V.

Figure 4A:
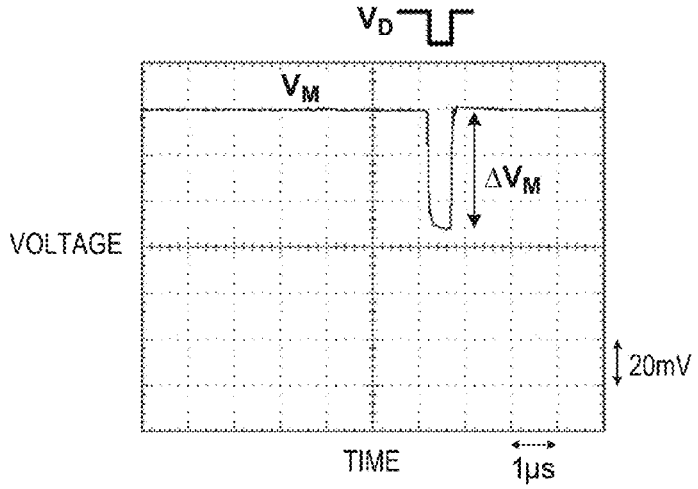
FIGS. 4A, 4B, and 4C are waveform charts showing examples of a detected waveform according to the first embodiment.
Figure 4B:
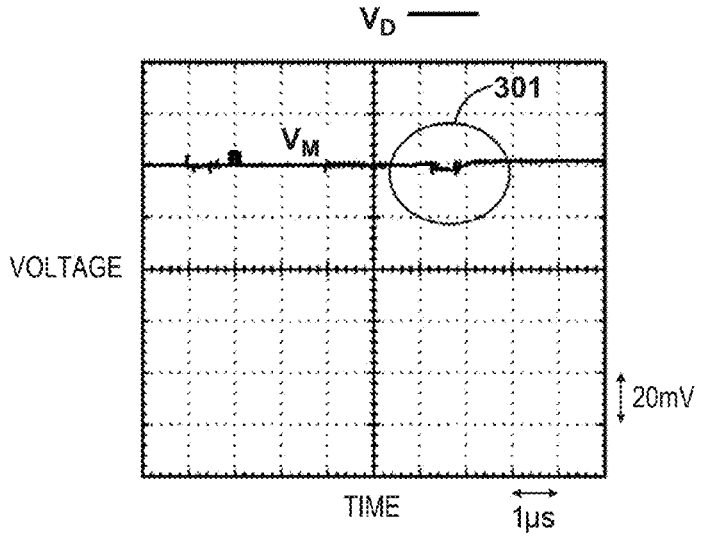

The potential change observed as the potential $V_M$ in the terminal 211 of the detection electrode 159 will be examined next. FIG. 4A shows a change in the potential $V_M$ detected by the detection electrode 159 when the drive switch 205 performs switching driving of the print element 107 that is assumed to be normal. According to the switching operation of the drive switch 205, the potential $V_D$ of the individual wire 156 exhibits a waveform as shown in FIG. 4A, and the potential $V_M$ changes accordingly. Here, the potential change $\Delta V_M$ is about 50 mV, which is assumed to be a potential change estimated using the equivalent circuits described with reference to FIGS. 3A, 3B, and 3C. On the other hand, FIG. 4B shows a waveform detected as the potential $V_M$ when the side of the common wire 160 is opened assuming disconnection of the print element 107. As indicated by reference numeral 301, the detected waveform does not change in correspondence with the absence of a change in the potential $V_D$ of the individual wire 156.

Figure 4C:
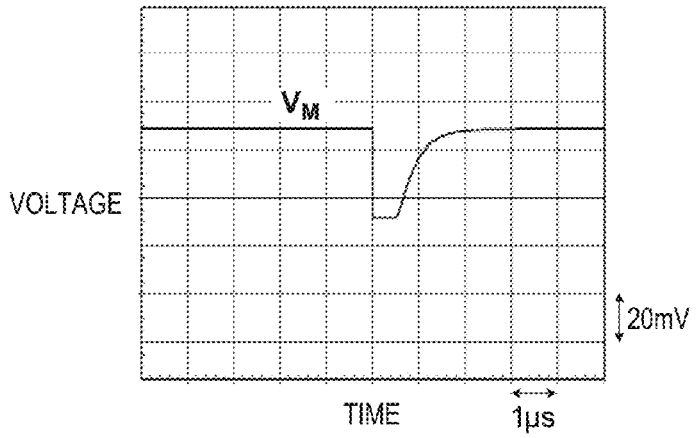

Disconnection in the print element 107 occurs in various forms. Not complete disconnection but a partial rupture may occur, and as a result, the resistance value of the print element 107 may become larger than the original value. FIG. 4C shows a result obtained by simulating the detected potential $V_M$ in a case in which such a partial rupture occurs in the print element 107. Here, assume that the resistance value of the print element 107 changes to 500 kohm upon a partial rupture. The detected waveform when the drive switch 205 changes from the OFF state to the ON state is the same as in the normal state. However, when the drive switch 205 changes from the ON state to the OFF state, the recovery of the potential delays due to the time constant of the print element 107 with a high resistance and the parasitic capacitance, and a waveform different from that in the normal state is exhibited.

Figure 5:
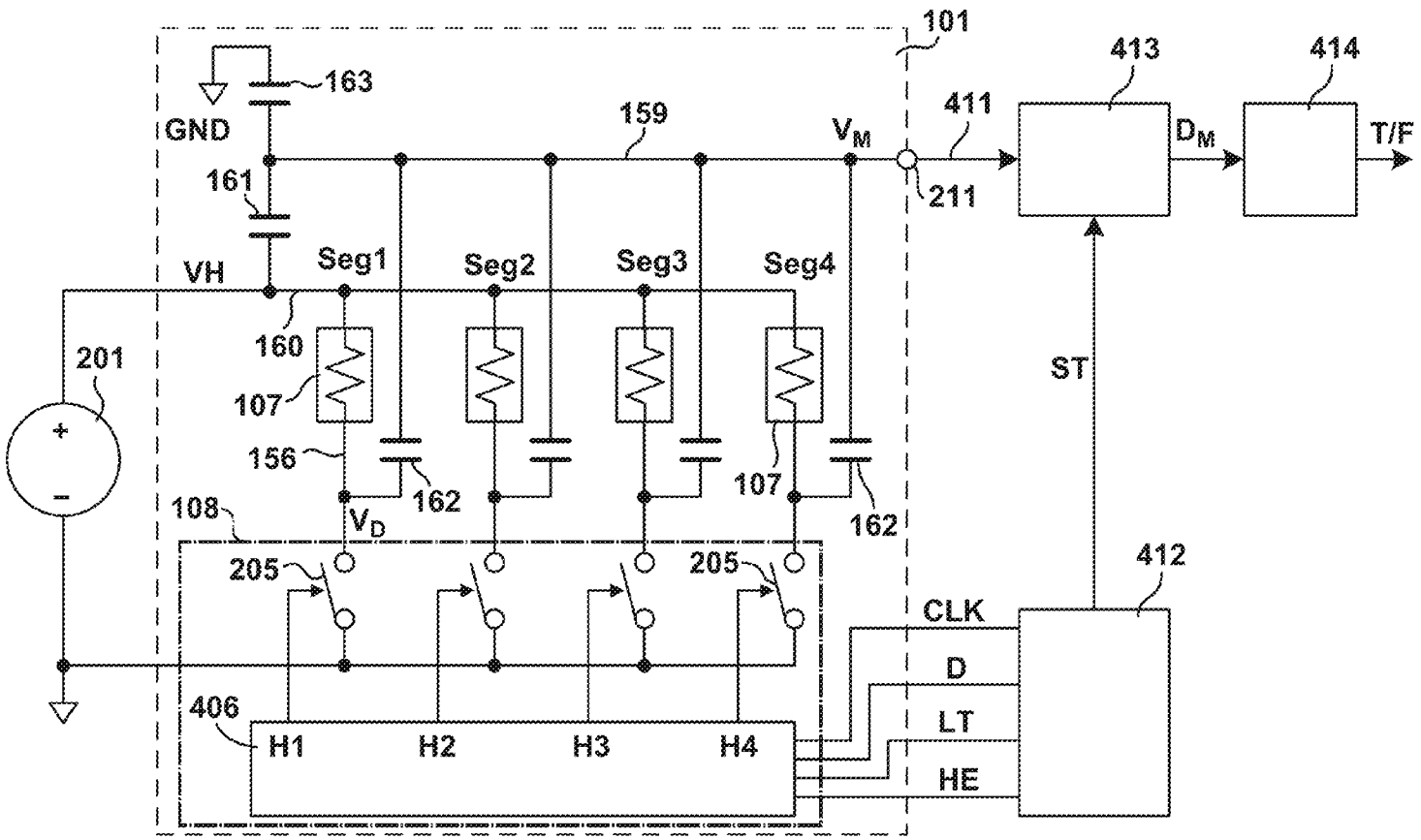
FIG. 5 is a block diagram showing the arrangements of the liquid discharge head and an inspection apparatus according to the first embodiment.

In this embodiment, the driving waveform that appears in the detection electrode 159 by the capacitive coupling is detected, and it is inspected whether the driving state of the print element 107 is normal. FIG. 5 shows an example of the arrangement of an inspection apparatus used for inspection. The inspection apparatus is connected to the element substrate 101 on which the print element 107 and the driving circuit 108 are provided, as described above. The inspection apparatus includes a control circuit 412 that controls an electrical signal for driving of the print element 107, and the above-described DC power supply 201 that supplies power to the print element 107. The inspection apparatus also includes a detection circuit 413 that is connected to the terminal 211 of the element substrate 101 via a wire 411 and detects the potential waveform $V_M$ of the detection electrode 159, and a determination circuit 414 that determines the driving state of the print element 107 based on information detected by the detection circuit 413. Assume that the print elements 107 of four segments are provided on the element substrate 101. The print elements 107 are discriminated by Seg1 to Seg4. The driving circuit 108 includes the drive switches 205 provided for the individual wires 156 connected to the respective print elements 107, and a selection circuit 406 that drives the drive switches 205. To individually output selection signals H1 to H4, the selection circuit 406 includes four output terminals. The four output terminals are connected to the control inputs of the four drive switches 205, respectively. The control circuit 412 outputs print data to the driving circuit 108, thereby controlling the electrical signal for driving of the print elements 107.

For example, the print element 107 of Seg1 has one terminal connected to the power supply line VH from the DC power supply 201 via the common wire 160, and the other terminal connected to the drive switch 205 via the individual wire 156. The other terminal of the drive switch 205 is connected to the ground potential GND as the return destination of the power supply line. The drive switch 205 is ON/OFF-controlled by the selection signal H1 from the selection circuit 406. When the drive switch 205 is turned on, the driving electrical signal is given to the print element 107, and the print element 107 is driven. The print elements 107 of Seg2 to Seg4 are also connected like the print element 107 of Seg1, and drive-controlled by the selection signals H2 to H4, respectively. The selection circuit 406 is formed from a 4-bit shift register and a 2-line decoder (neither are shown). Upon receiving print data from the control circuit 412, the selection circuit 406 generates the selection signals H1 to H4 and 2×2 time-divisionally drives the print elements 107 of Seg1 to Seg4. FIG. 5 also illustrates the capacitance 161 between the detection electrode 159 and the common wire 160, the capacitance 162 between the detection electrode 159 and the individual wire 156, and the capacitance 163 between the detection electrode 159 and the ground potential of the silicon substrate or the like. The capacitance values of the capacitances 161 to 163 are C1 to C3, as described above.

Figure 6:
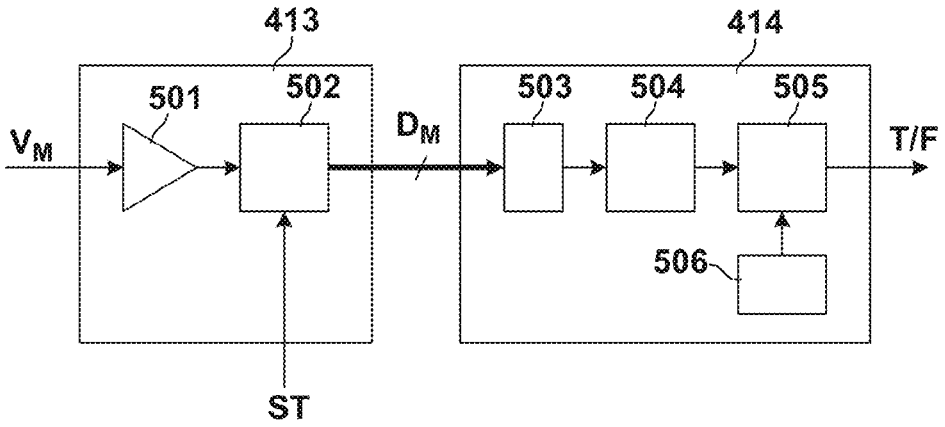
FIG. 6 is a block diagram showing the arrangements of a detection circuit and a determination circuit in the inspection apparatus.

FIG. 6 shows the arrangements of the detection circuit 413 and the determination circuit 414. The detection circuit 413 includes an amplifier 501 to which the detected waveform $V_M$ that appears in the terminal 211 is input, and an A/D (analog/digital) converter 502 that converts the amplified detected waveform into a digital value $D_M$. The amplifier 501 is formed from an amplification circuit having a high input impedance and a small input capacitance so as not to affect the detected waveform $V_M$. The determination circuit 414 includes a memory 503 that stores the digitized detected waveform data $D_M$, and a calculator 504 that performs a calculation for the waveform data stored in the memory. The determination circuit 414 further includes a memory 506 that stores determination criterion data, and a comparator 505 that compares the calculation result of the calculator 504 with the determination criterion data in the memory 506, determines whether the print element is normal or defective, and outputs the result. The output of the comparator 505 is represented by a true/false signal (T/F) that changes to true (T) when the print element is determined as normal or false (F) when the print element is determined as defective.

Figure 7:
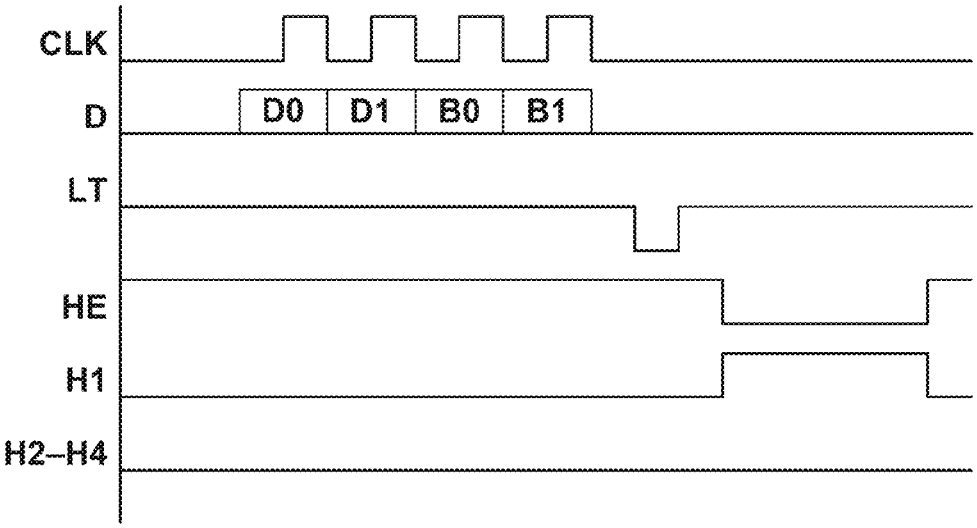
FIG. 7 is a timing chart showing a data transfer timing to the liquid discharge head according to the first embodiment.

The operation of the above-described inspection apparatus will be described next. FIG. 7 shows an example of the data transfer timing of print data sent from the control circuit 412 to the selection circuit 406 of the element substrate 101. The control circuit 412 transfers 2-bit row data DO and Dl and block data B0 and B1 that are column data, which are arranged on a serial data signal D, in synchronism with a transfer clock signal CLK. The control circuit 412 also gives a latch pulse by a latch signal LT and causes the selection circuit 406 to hold these data. Immediately after that, the control circuit 412 outputs an application signal HE representing the application timing of a pulse to the print element 107. Accordingly, a driving pulse for the print element 107 of a segment designated by the serial data signal D is given to the drive switch 205 at a timing when the application signal HE is at low level, and the print element 107 is pulse-driven. FIG. 7 shows a driving pulse when only Seg1 is selected.

Figure 8:
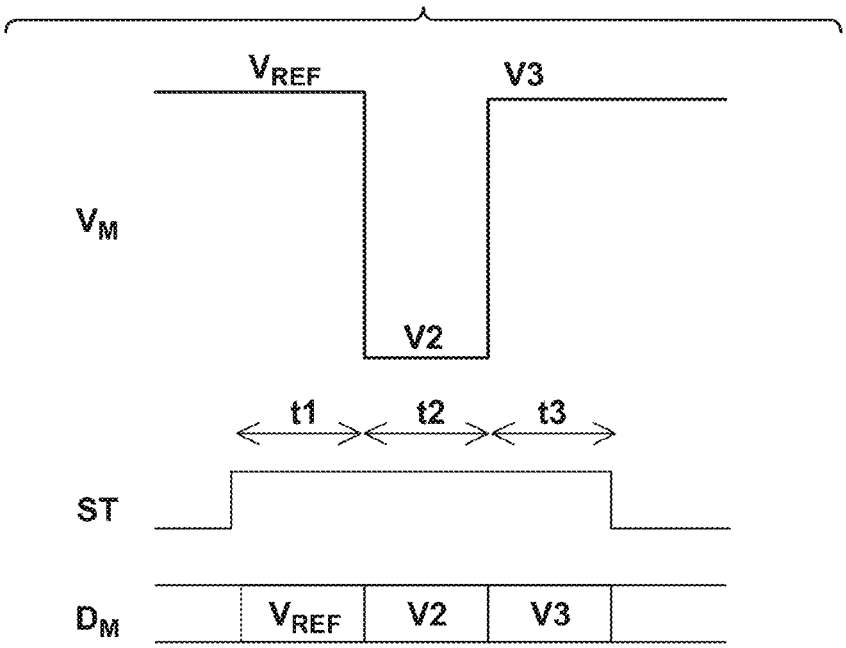
FIG. 8 is a timing chart showing the operation timing of the detection circuit shown in FIG. 6.

The detection circuit 413 detects the potential waveform $V_M$ of the detection electrode 159 according to driving of the print element 107 by the driving pulse as shown in FIG. 7. FIG. 8 shows the operation timing of the detection circuit 413. In a period t1 before driving of the print element 107, a start signal ST of A/D conversion is turned on. In a period t2 next to the period t1, the print element 107 is driven. At the end of the period t2, the driving of the print element 107 is turned off. The period t2 is the period of pulse driving of the print element 107. At the end of a period t3 next to the period t2, the start signal ST of A/D conversion is turned off. With this driving, the detected waveform $V_M$ can be obtained from the period t1 to the period t3. The detected waveform during the period t1 is defined as an initial potential $V_{REF}$, that during the period t2 is defined as a potential V2, and that during the period t3 is defined as a potential V3. The initial potential $V_{REF}$ and the potentials V2 and V3 are A/D-converted and supplied to the determination circuit 414 as the detected waveform data $D_M$.

Figure 9:
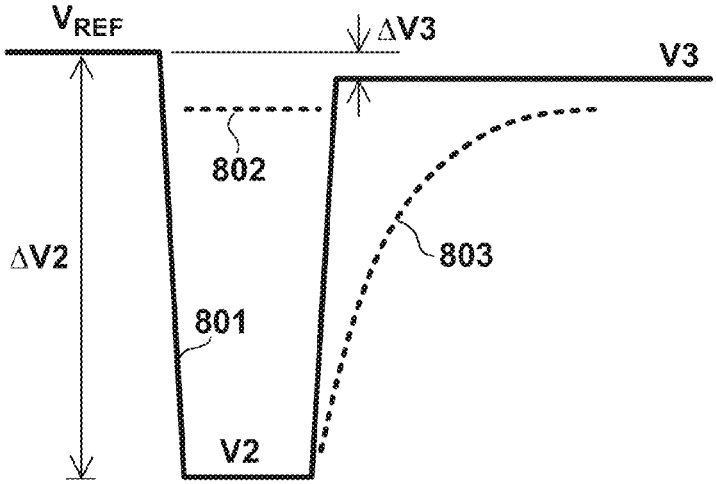
FIG. 9 is a waveform chart for explaining an inspection element in the detected waveform according to the first embodiment.

FIG. 9 shows which part of the detected waveform data $D_M$ is used as a determination element by the determination circuit 414 when performing determination processing. If the print element 107 is normal, the detected waveform data $D_M$ changes as shown in FIG. 4A. In FIG. 9, the detected waveform in the normal state is schematically indicated by a thick solid line 801. As a first determination element, a potential change ΔV2 representing how much the potential V2 as the potential during driving of the print element 107 has changed with respect to the initial potential $V_{REF}$ is used. That is, $\Delta V2=|V2-V_{REF}|$. If the print element 107 is normal, ΔV2 has a value or a certain magnitude or more, as described above. However, if the print element 107 is disconnected, the potential V2 hardly changes from the initial potential $V_{REF}$, as described with reference to FIG. 4B, and ΔV2 has a value close to 0. A dotted line 802 in FIG. 9 schematically indicates the detected waveform data $D_M$ when the print element 107 is disconnected. Hence, if ΔV2 is equal to or less than a predetermined threshold, the value falls outside an allowable range, and it can be determined that the print element is defective.

As a second determination element, a potential change ΔV3 representing how much the potential V3 as the potential after the end of driving of the print element 107 has changed with respect to the initial potential $V_{REF}$ is used. That is, $\Delta V3=|V3-V_{REF}|$. If the print element 107 is normal, the detected waveform quickly approaches the initial potential $V_{REF}$ after the end of driving, and therefore, ΔV3 has a small value. However, if the print element 107, for example, partially ruptures and has a resistance value larger than in the normal state, return of the detected waveform to the initial potential $V_{REF}$ after the end of driving delays, as shown in FIG. 4C, and as a result, ΔV3 has a large value. A dotted line 803 in FIG. 9 schematically indicates the detected waveform data $D_M$ when the print element 107 partially ruptures. Hence, if ΔV3 is equal to or more than a predetermined threshold, the value falls outside an allowable range, and it can be determined that the print element is defective.

The determination circuit 414 executes the above-described determination processing by following data processing. First, the calculator 504 receives the detected waveform data $D_M$ stored in the memory 503, and generates data representing the potential changes ΔV2 and ΔV3. A determination criterion value is stored in the memory 506 in advance as determination criterion data. The comparator 505 compares ΔV2 and ΔV3 with the determination criterion value in the memory 506, and generates the true/false signal T/F.

Figure 10:
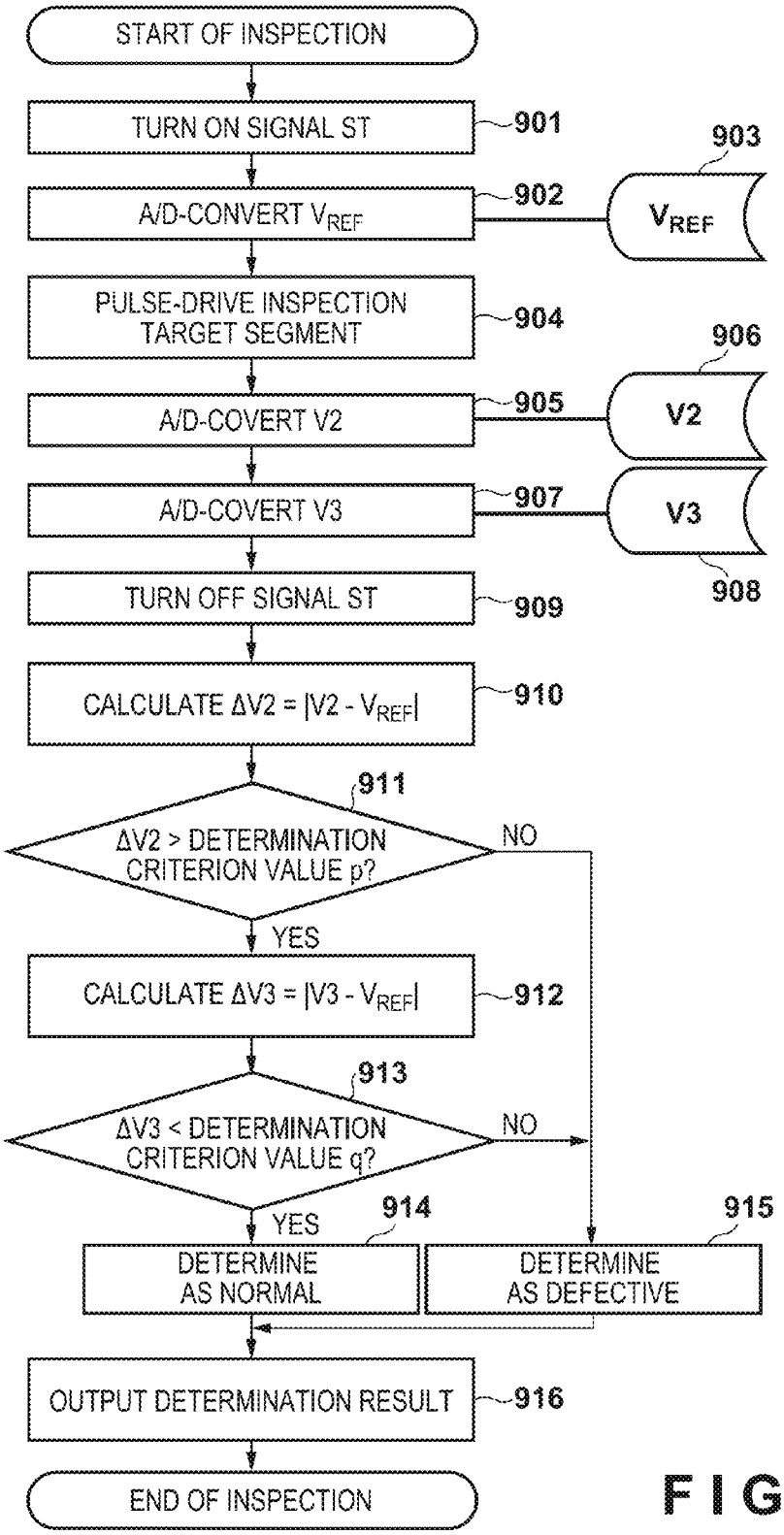
FIG. 10 is a flowchart showing steps of inspection according to the first embodiment.

FIG. 10 is a flowchart showing the operation contents of the inspection apparatus. Processing of determining the quality of one segment (for example, Seg1) will be described here. First, in step 901, the control circuit 412 turns on the start signal ST to start A/D conversion. The detection circuit 413 starts receiving the potential $V_M$ of the detection electrode 159, that is, the detected waveform. This time corresponds to the period t1, and the potential $V_M$ is the initial potential $V_{REF}$. In step 902, the initial potential $V_{REF}$ is A/D-converted. In step 903, the data of the converted potential $V_{REF}$ is stored in the memory 503. Next, in step 904, the control circuit 412 selects an inspection target segment and transfers print data. The print element 107 of the selected segment is thus pulse-driven. This time corresponds to the period t2, and the potential $V_M$ of the detection electrode 159 is V2. In step 905, the potential V2 is A/D-converted. In step 906, the data of the converted potential V2 is stored in the memory 503.

When driving of the print element 107 ends, the period t3 starts. The potential $V_M$ of the detection electrode 159 at this time is V3. In step 907, the potential V3 is A/D-converted. In step 908, the data of the converted potential V3 is stored in the memory 503. After that, in step 909, the control circuit 412 turns off the start signal ST to stop reception of the detected waveform $V_M$. In step 910, the calculator 504 generates the potential change data ΔV2 by $\Delta V2=|V2-V_{REF}|$. In step 911, the comparator 505 compares a determination criterion value p with ΔV2. ΔV2 is larger in the normal state of the print element 107 than in the defective state. If ΔV2 exceeds p, the comparator 505 determines that the print element 107 is not disconnected, and the process advances to step 912. Otherwise, the process advances to step 915 to determine the print element 107 as defective. In step 912, the calculator 504 generates the potential change data ΔV3 by $\Delta V3=|V3-V_{REF}|$. In step 913, the comparator 505 compares a determination criterion value q with ΔV3.

ΔV3 is larger in a state in which the print element 107 partially ruptures than in the normal state. If ΔV3 is less than q, the comparator 505 advances to step 914 and determines that the print element 107 is normal. Otherwise, the comparator 505 advances to step 915 and determines the print element 107 as defective. After execution of step 914 or 915, in step 916, the comparator 505 outputs the determination result as the true/false signal T/F.

The procedure of inspecting the print element 107 of one segment has been described above. By sequentially applying this procedure to the print elements 107 of the remaining segments included in the liquid discharge head, all print elements 107 of the liquid discharge head can be inspected. A case in which the potential changes ΔV2 and ΔV3 are used as the determination elements has been described here. However, the determination accuracy may be improved by, for example, monitoring the potential changes at a shorter time interval in correspondence with various error modes that can occur in the print element 107.

The flowchart of FIG. 10 is applicable to a case in which the print elements 107 are sequentially inspected on a segment basis. In the element substrate 101 that is 2×2 time-divisionally driven, however, inspection can be performed even when two segments are simultaneously driven. In this case, since C2 in equations (1) and (2) described above doubles, the potential change $\Delta V_M$ in the normal state doubles. The determination criterion value is changed accordingly. In a case in which inspection is performed by simultaneously driving two segments, if one of the two simultaneously driven segments is defective, the defective segment cannot be specified, but speedup of the inspection can be achieved.

In this embodiment, inspection can be executed in an actual operation environment of the liquid discharge head without changing the operation condition during, for example, printing. It is also possible to inspect the quality of driving of an energy generation element without any influence of a filled state of a liquid or the like. When the liquid discharge head is an inkjet print head, the above-described inspection is performed in combination with print inspection, thereby discriminating the cause of deterioration of print quality between an electrical failure and a fault in an ink channel and eliminating an unnecessary recovery operation.

The second embodiment of the present invention will be described next. In the first embodiment, a case in which the detection electrode is provided commonly for all segments has been described. In the second embodiment, a detection electrode is separately provided for each segment.

Figure 11:
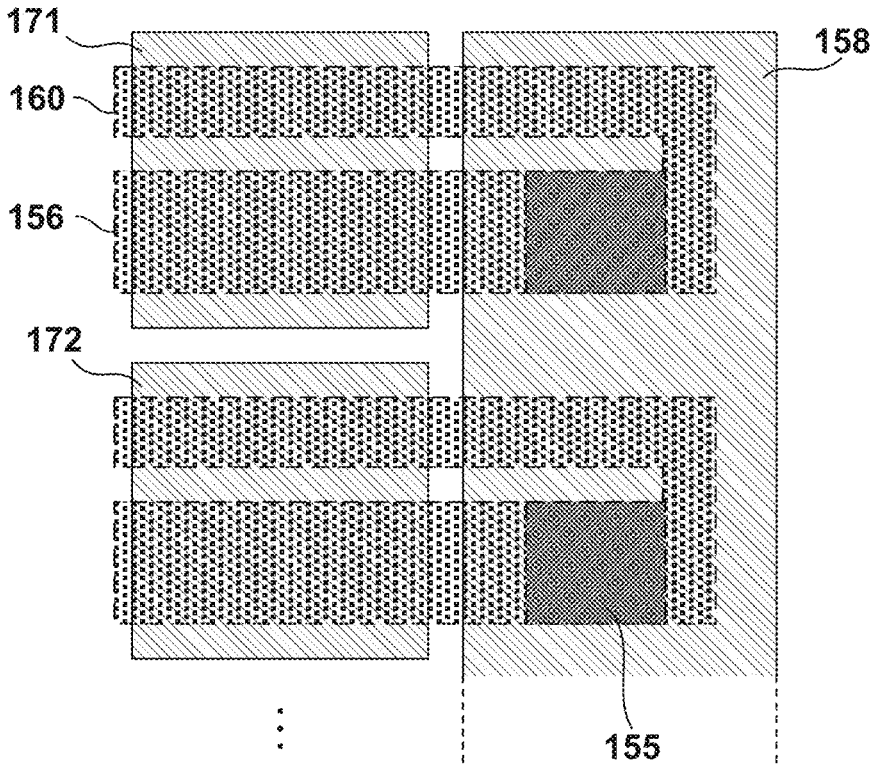
FIG. 11 is a plan view showing the structure of an element substrate in a liquid discharge head according to the second embodiment.

FIG. 11 is a plan view of the print element portion of a liquid discharge head according to the second embodiment. FIG. 11 shows the print elements of two segments. As in the first embodiment, out of a resistive heating layer 155, a portion without a wiring layer formed on it corresponds to a print element 107 (see FIG. 12). An individual wire 156 and a common wire 160 are connected to each print element 107. An anti-cavitation film 158 is provided commonly for the plurality of print elements so as to cover the print elements. On the other hand, the detection electrode is provided for each segment. For example, in correspondence with the print element on the upper side of FIG. 11, a detection electrode 171 is provided to cover the individual wire 156 and the common wire 160 to the print element except a position where the print element is arranged. Similarly, in correspondence with the print element on the lower side of FIG. 11, a detection electrode 172 is provided to cover the individual wire 156 and the common wire 160 to the print element except a position where the print element is arranged. The detection electrodes 171 and 172 are separated, and detected waveforms can be obtained separately. FIG. 11 shows a portion corresponding to print elements of two segments. However, as indicated by a dotted line in FIG. 11, a plurality of print elements may further be provided following the print element on the lower side of FIG. 11. In this case, detection electrodes are further provided for the print elements. Each of the detection electrodes 171, 172, . . . is accompanied with a capacitance 161 (see FIG. 12) with respect to the common wire 160, a capacitance 162 (see FIG. 12) with respect to the individual wire 156, and a capacitance 163 (see FIG. 12) with respect to the ground potential of a silicon substrate or the like, as shown in FIGS. 3A, 3B, and 3C. The values of the capacitances 161 to 163 are C1, C2, and C3, respectively. Note that for the descriptive convenience, the individual wire 156, the common wire 160, and the resistive heating layer 155 of the portion covered with the anti-cavitation film 158 and the detection electrodes 171 and 172 serving as an upper protection film are illustrated in FIG. 11, but a lower protection film 157 is not illustrated.

Figure 12:
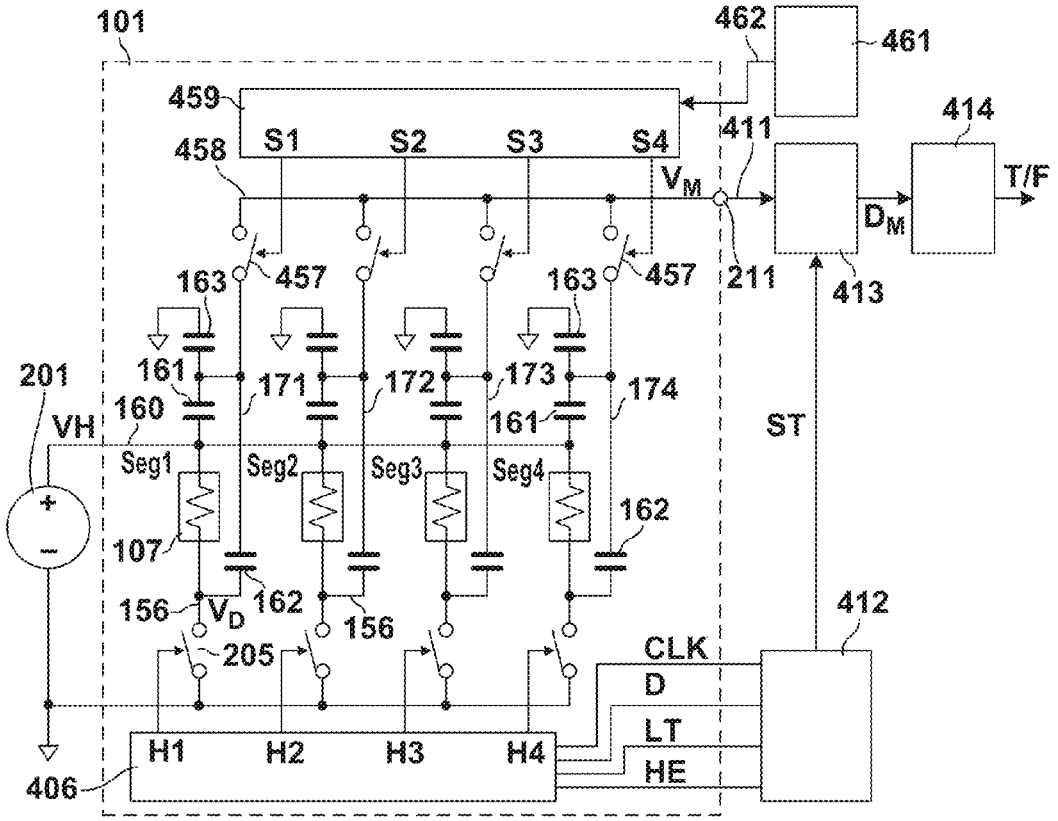
FIG. 12 is a block diagram showing the arrangements of the liquid discharge head and an inspection apparatus according to the second embodiment.

In the second embodiment, the driving waveform that appears by the capacitive coupling in each of the detection electrodes 171, 172, . . . , provided for the respective print elements is detected, and it is inspected for each print element whether the driving state of the print element is normal. FIG. 12 shows an example of the arrangement of an inspection apparatus used for inspection according to the second embodiment. The inspection apparatus shown in FIG. 12 has the same circuit arrangement as that described with reference to FIG. 5 in the first embodiment except that a circuit configured to select one of the detection electrodes is provided in correspondence with the structure with the detection electrodes being provided for the respective print elements. Assume that four print elements 107 are provided on an element substrate 101, and the detection electrodes 171 to 174 correspond to the print elements 107 of Seg1 to Seg4, respectively.

A common wire 458 connected to a terminal 211 on the element substrate 101 is provided on the element substrate 101. The detection electrodes 171 to 174 are connected to the common wire 458 via read switches 457 for the detection electrodes. A detection circuit 413 is connected to the terminal 211 via a wire 411, as in the first embodiment. A selection circuit 459 is provided to individually ON/OFF-control the four read switches 457 provided on the element substrate 101. The read switches 457, the common wire 458, and the selection circuit 459 are provided on the element substrate 101. The selection circuit 459 outputs selection signals S1 to S4 corresponding to the four read switches 457. For example, the read switch 457 connected to the detection electrode 171 is ON/OFF-controlled by the selection signal S1. The selection circuit 459 generates the selection signal by receiving selection data 462 from a selection control circuit 461 provided outside the element substrate 101.

An example of an operation according to the second embodiment will be described next. First, the selection circuit 459 turns on the read switch 457 for the print element 107 of Seg1. After that, steps 901 to 903 (see FIG. 10) of the first embodiment are executed for the print element 107 of Seg1 to drive the print element 107 of Seg1. A detected waveform $V_M$ of the detection electrode 171 corresponding to Seg1 is thus read via the common wire 458. This detected information is processed by the procedure in steps 905 to 916 of FIG. 10, thereby detecting the detected waveform $V_M$, and the quality of the print element 107 of Seg1 is determined based on determination elements. From then on, the quality of the print element 107 of the next segment is sequentially determined, as in the first embodiment.

In the above-described operation example, inspection is performed by synchronizing selection of a detection electrode for each print element with selection of a corresponding print element. However, the inspection can also be performed by, for example, measuring the potential of each detection electrode during an actual print operation. The driving state of the print element 107 during operation can also be inspected by turning on the read switch 457 to the detection electrode corresponding to the print element 107 to be inspected for various print patterns and receiving the detected waveform when the print element 107 is driven.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-041138, filed Mar. 3, 2015, which is hereby incorporated by reference herein in its entirety.

What is claimed is:

1. An inspection apparatus for inspecting a liquid discharge head including an energy generation element configured to generate energy for discharging liquid, a wiring layer for supplying an electrical signal to the energy generation element, the wiring layer including a first wiring connected to one end of the energy generation element and a second wiring connected to the other end of the energy generation element, a first conductive protection film extending from the first wiring to the second wiring, and a second protection film having an electrical insulating property and provided between the wiring layer and the first protection film, comprising:

a detection circuit configured to detect a potential of the first protection film when the electrical signal is supplied to the energy generation element; and a determination circuit configured to determine a driving state of the energy generation element from information about the potential detected by the detection circuit.

2. The apparatus according to claim 1, wherein the first protection film is electrically separated into a first portion arranged in correspondence with a position where the energy generation element is formed and a second portion arranged in correspondence with a position where the wiring layer is formed, and the detection circuit is electrically connected to the second portion and detects a potential of the second portion.

3. The apparatus according to claim 1, wherein the information detected by the detection circuit is information of a potential change detected when the energy generation element of an inspection target is driven by the electrical signal.

4. The apparatus according to claim 3, wherein the determination circuit determines that the energy generation element is normal when the potential change falls within a predetermined range, and determines that the energy generation element is defective when the potential change falls outside the predetermined range.

5. The apparatus according to claim 3, further comprising a control circuit configured to control the electrical signal for driving and pulse-drive the energy generation element, wherein the determination circuit determines that the energy generation element is disconnected when a magnitude of the potential change between a period before the energy generation element is pulse-driven and a period in which the energy generation element is being pulse-driven is not more than a first threshold, and determines that the energy generation element is partially ruptured when the magnitude of the potential change between the period before the energy generation element is pulse-driven and a period after the pulse driving has ended is not less than a second threshold.

6. An inspection method for inspecting a liquid discharge head including an energy generation element configured to generate energy for discharging liquid, a wiring layer for supplying an electrical signal to the energy generation element, the wiring layer including a first wiring connected to one end of the energy generation element and a second wiring connected to the other end of the energy generation element, a first conductive protection film extending from the first wiring to the second wiring, and a second protection film having an electrical insulating property and provided between the wiring layer and the first protection film, comprising:

detecting a first potential of the first protection film when the electrical signal is not supplied to the energy generation element;

supplying the electrical signal for driving the energy generation element;

detecting a second potential of the first protection film when the electrical signal is supplied to the energy generation element; and determining a driving state of the energy generation element based on information about the first potential and the second potential.

7. The method according to claim 6, further comprising:

stopping supplying the electrical signal after detecting the second potential of the first protection film; and detecting a third potential of the first protection film after stopping supplying of the electrical signal, wherein the determining includes determining the driving state of the energy generation element based on information about the first potential, the second potential and the third potential.

8. A liquid discharge head comprising:

an energy generation element configured to generate energy for discharging liquid;

a wiring layer for supplying an electrical signal to the energy generation element, the wiring layer including a first wiring connected to one end of the energy generation element and a second wiring connected to the other end of the energy generation element;

a first conductive protection film extending from the first wiring to the second wiring;

a second protection film having an electrical insulating property and provided between the wiring layer and the first protection film; and a terminal configured to electrically connect to the first protection film.

9. The liquid discharge head according to claim 8, wherein the liquid is ink.

10. The liquid discharge head according to claim 9, wherein the liquid discharge head is an inkjet print head.

11. The liquid discharge head according to claim 8, wherein the energy generation element is a resistive heating element.

12. The liquid discharge head according to claim 8, wherein the first protection film is electrically separated into a first portion arranged in correspondence with a position where the energy generation element is formed and a second portion arranged in correspondence with a position where the wiring layer is formed, and wherein the first portion includes an anti-cavitation film configured to protect the energy generation element from cavitation.

13. The liquid discharge head according to claim 8, wherein an insulation film is provided between the first wiring and the second wiring.

14. The liquid discharge head according to claim 8, wherein the wiring layer, the first protection film and the second protection film are formed on a surface of a silicon substrate fixed to ground potential.

* * * * *